United States Patent [19]

McShane

[11] Patent Number: 4,967,687

[45] Date of Patent: Nov. 6, 1990

[54] APPARATUS FOR DYEING EGGS

[75] Inventor: James E. McShane, Memphis, Tenn.

[73] Assignee: Plough, Inc., Memphis, Tenn.

[21] Appl. No.: 282,098

[22] Filed: Dec. 8, 1988

[51] Int. Cl.[5] ..... B05C 1/02

[52] U.S. Cl. ..... 118/13; 118/26; 118/264; 118/270; 206/223

[58] Field of Search ..... 8/514, 526, 636; 118/13, 26, 28, 264, 270; 206/206, 216, 219, 223; 426/300, 302, 86, 540

[56] References Cited

U.S. PATENT DOCUMENTS

| | | | |
|---|---|---|---|
| 3,180,850 | 6/1965 | Anthony | 426/86 |
| 3,252,803 | 5/1966 | Belasco | 426/293 |
| 3,745,973 | 7/1973 | Knecht | 426/250 |
| 4,050,826 | 9/1977 | Berghahn | 401/196 |
| 4,181,745 | 1/1980 | Growe | 426/250 |
| 4,336,767 | 6/1982 | Wada | 401/196 |
| 4,419,103 | 12/1983 | Balkan | 426/250 |
| 4,693,205 | 9/1987 | Thill | 426/300 |

*Primary Examiner*—Willard Hoag

*Attorney, Agent, or Firm*—Thomas D. Hoffman; Henry C. Jeanette; Gerald S. Rosen

[57] ABSTRACT

A shaped container of a size suitable having an insert having a face coated with a dry water-soluble dyeing composition and a method of dyeing eggs using said shaped containers and a kit containing various shaped containers, each having therein different dry water-soluble dyeing compositions.

11 Claims, 1 Drawing Sheet

APPARATUS FOR DYEING EGGS

CROSS-REFERENCE TO RELATED APPLICATION

This is a patent application related to my copending U.S. patent application Ser. No. 097,038 filed Sept. 16, 1987, now U.S. Pat. No. 4,853,240.

BACKGROUND OF THE INVENTION

This invention relates to a shaped container of a size suitable for dyeing eggs having therein an insert coated with a dry water-soluble dyeing composition and a means for securing such insert, as well as the method of dyeing eggs using such a shaped container. This invention also relates to a kit for use in dyeing eggs, containing various shaped containers, containers wherein each shaped container has therein on an insert having a shape substantially the same as the bottom inside of the container and coated with a different colored dry water-soluble dyeing composition.

Eggs generally are dyed for decorative purposes, usually as colored Easter eggs intended primarily for use by children. For many years, such eggs have been dyed by dipping them in water containing a water-soluble dye. The dye is usually placed in the water as a tablet or powder. Although this has been an accepted practice for many years, dyeing eggs creates a mess and in many cases produces unsatisfactory results.

Various methods of dyeing eggs have been proposed to overcome these problems. For example, U.S. Pat. No. 4,181,745 discloses a process for dyeing eggs by applying a dry granular dyeing medium to the hydrated shell of an egg positioned in a plastic bag. U.S. Pat. No. 4,664,925 discloses a method of pretreating eggs in boiling water at pH of 3.2–3.6 to enhance their dyeability and of imparting a flavor fragrance to such treated dyed eggs. Other methods and compositions for dyeing eggs are disclosed in U.S. Pat. Nos. 3,252,803, 4,181,745, 4,371,555, 4,419,103, 4,165,390, 4,139,645 and 2,593,566. None of these methods involve a shaped container having a disk coated with a dry water-soluble dyeing composition.

Egg Coloring Cubes Easter Egg Decorating kit for dyeing eggs have been sold by Spearhead Industries, Inc. and includes coloring cubes assembled from dye-coated folding cardboard boxes as well as sponge chips but the use of the Egg Coloring Cubes in combination with wetted sponge chips requires gloves and results in unevenly dyed eggs.

My copending U.S. patent application Ser. No. 097,038, filed Sept. 16, 1987 discloses shaped containers coated on an inside surface with a water-soluble dyeing composition suitable for dyeing eggs.

There is still a need for a simple method and kit for dyeing eggs evenly without use of gloves and without creating a mess.

SUMMARY OF THE INVENTION

The present invention provides a shaped container having an insert coated with a dry water-soluble dyeing composition, methods for the use of the shaped container for dyeing eggs, an insert coated with a dry water-soluble dyeing composition, and method for preparation of the insert coated with a dry water-soluble dyeing composition. In one aspect of the invention, the shaped container of a size suitable for dyeing eggs comprises (a) a top opening in,
(b) side walls connected to,
(c) a bottom,
(d) an insert having at least one face coated with a dry water-soluble dyeing composition, and
(e) means for securing said insert in a position at the bottom of said shaped container.

Another aspect of the present invention provides a shaped container of a size suitable for dyeing eggs comprising:

(a) a top opening in,
(b) side walls connected to,
(c) a bottom,
(d) a disk having at least one face coated with a dry water-soluble dyeing composition, and
(e) an annular inward protrusion positioned in said side walls and having a circumferential size slightly smaller than the size of said disk sufficient to hold said disk in the position at the bottom of said shaped container.

The present invention also provides a method of forming a dry water-soluble dyeing composition on a face of corona-treated polystyrene, which comprises (a) applying to a face of corona-treated polystyrene an admixture of about 50 to 74 weight percent of water, about 12 to about 20 weight percent of water-soluble carrier, about 2 to about 5 weight percent of a water-soluble plasticizer for said carrier, about 10 to about 30 weight percent of a water-soluble dye or mixtures thereof, (b) drying the admixture coated on said face to form a dry water-soluble dyeing composition on the face of said polystyrene.

The present invention also provides a corona-treated polystyrene sheet containing on predetermined areas thereof a dry water-soluble dyeing composition comprising about 2 to about 5 parts by weight of a water soluble dye carrier plasticizer about 12 to about 20 parts by weight of a water-soluble dye carrier and about 10 to about 30 parts by weight of a water-soluble dye.

The present invention still further provides an improved method of dyeing eggs wherein an egg is contacted with an aqueous dyeing medium for a time sufficient to dye the egg and the dyed egg is removed therefrom and allowed to dry, the improvement which comprises preparing the aqueous dyeing medium by admixing in a shaped container having an insert coated on a face thereof with a dry water-soluble dyeing composition, water and an acidifying agent in amounts sufficient to activate the water-soluble dyeing composition and form an aqueous dyeing medium, wherein the water-soluble dye composition comprises about 12 to about 20 parts by weight of a water-soluble dye carrier, about 10 to about 30 parts by weight of water-soluble dye, and about 2 to about 5 parts by weight of a water-soluble dye plasticizer for said carrier.

The kit of this invention comprises a multiplicity of shaped containers, wherein an insert in each container has on at least one face thereof a coating of a different colored dry water-soluble dyeing composition or mixture of such dyeing compositions.

DETAILED DESCRIPTION

Figure 1:
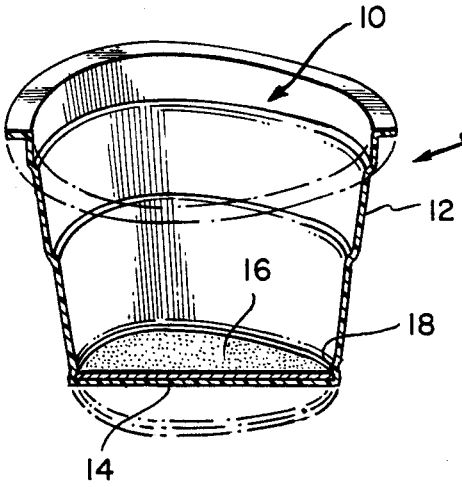
FIG. 1 is a side elevational view of a preferred embodiment of the present invention showing a partially flat bottomed hemioval-shaped container having an oval insert coated with a dry water-soluble dyeing composition.

I have discovered another simple and convenient shaped-containers and a method of using such shaped containers to dye eggs evenly without the mess and uncertain results associated with prior art kits and methods. Such containers and methods are distinctly different compared to those disclosed in my co-pending U.S. patent application Ser. No. 097,038, filed 9/16/87. In a preferred embodiment of the present invention, the shaped container contains an insert formed from a sheet of corona-treated polystyrene coated by silk-screening, printing, spraying and the like on a predetermined area of at least one face thereof with a dry water-soluble dyeing composition of the present invention.

The coating of the dry water-soluble dyeing composition of this invention on the corona-treated polystyrene inserts maintained integrity and adhesion to said polystyrene and in addition readily dissolved in water to form a homogeneous dyeing medium for eggs.

Surprisingly, I discovered that the coating of the same dry water-soluble dyeing composition used above onto non-corona-treated polystyrene spontaneously peels off of the polystyrene upon storage.

The coated corona-treated polystyrene used as insert material is cut into shapes compatible with containers of various shapes, e.g., cubes, cylinders hemi-oval or hemispheres which shapes are suitable to hold an egg. It is a special feature of the shaped-containers containing the coated inserts of compatible shapes that it is possible to use less water to form a concentrated egg dyeing solution which produces more intensely colored eggs than those dyed by conventional means using the same immersion time, or uses less immersion time to obtain similar color intensity as is produced by conventional immersion times. It is also possible to use less dye while providing eggs having a color intensity equal to colors formed using prior art methods. The shaped-containers may preferably have at least partially flat bottoms and more preferably be egg-shaped and having an insert coated on a face with a dry water-soluble dyeing composition of the present invention (See FIG. 1).

Insert materials found useful for the present invention include corona-treated food grade polystyrene such as is available from Primex Plastics Corp., 65 River Drive, Garfield, N.J., 07026, food grade polystyrene available from Chevron Chemical, as well as paper suitable for use as labelling stock. The preferred insert material is corona-treated food grade polystyrene.

By the term "corona-treated polystyrene" used herein is meant food grade polystyrene treated with a high potential discharge for a time sufficient to leave a net potential difference (non-zero charge) on the polystyrene.

As used herein "eggs" means intact, unbroken eggs, preferably boiled chicken eggs.

Typical suitable acidifying agents include any food grade water-soluble organic acid or food grade mineral acid including potassium bitartrate (cream of tartar), potassium acid phosphate, tartaric acid, malic acid, citric acid, acetic acid, lactic acid, dilute HCl, glycine and HCl, citrate and HCl and the like. The acidifying agents are usually present as dilute (0.1N) aqueous solutions. The preferred acidifying agent is acetic acid (vinegar).

Typical suitable water-soluble dye carriers include polyethylene glycols, especially polyethylene glycol 3350 and polyvinyl alcohol as well as other dye carriers well known to those skilled in the art. Polyvinyl alcohol is the preferred dye carrier.

Typical suitable water-soluble dye plasticizers for the carrier include propylene glycol, low molecular weight polyethylene glycols "PEG" e.g. PEG having a molecular weight less than about 600, and glycerine. A typical low molecular weight PEG is PEG 400. Other dye plasticizers well known to those skilled in the art and which act as humectants to maintain the flexibility of the coating of the dry water soluble dyeing composition on the insert material by preventing complete dehydration of the water-soluble dyeing composition provide adhesion between the insert material and the dry water-soluble dyeing composition of this invention are also included within the scope of this invention. When polyvinyl alcohol is used as a water-soluble dye carrier, the preferred water-soluble dye plasticizer for such a carrier is glycerin.

One or more preservatives may be included in the water-soluble dyeing compositions. Typically about 0.04 to about 0.3 weight percent of sodium benzoate, USP and 0.1 to about 0.5 weight percent of citric acid, USP are included as preservatives. Other suitable preservatives include the parabens, e.g. methylparaben, propylparaben which are usually included in an amount of about 0.1 to about 0.2 weight percent of the aqueous dyeing medium.

In one aspect of the method of the present invention, a preformed shaped container, such as a cup having an insert coated on a face thereof with the dry water-soluble dyeing composition of the present invention is used to dye eggs. The method of dyeing eggs in its first step entails preparation of an aqueous dyeing medium by adding, with stirring, water and an acidifying agent, e.g. dilute acetic acid or vinegar, to a preformed shaped container having an insert coated with the dry water-soluble dyeing composition and mixing. The mixing of the solution which is accomplished with a stirrer such as a spoon or any similar stirring device readily available in the home is continued until an aqueous dyeing medium is produced. The amounts of water and acidifying agent such as vinegar are not critical, but should be sufficient to dissolve and thereby activate the water-soluble dye composition present on the insert of the shaped container and form an aqueous dyeing medium of a volume sufficient to cover the egg to be dyed. Normally for a 6–8 oz cup, about 2–4 oz (60–120 mL) of water and 1 tablespoon (15 mL) of vinegar are added to each shaped container having an insert coated on one face with about 0.004 oz (0.12 mL) of a water-soluble dyeing composition of a desired color.

In the next step of the method of dyeing eggs, the egg is dipped into the aqueous solution of the desired dye and held there for a time sufficient to dye the egg, usually about 2 or 3 minutes.

In the next step of the method of dyeing eggs, the dyed egg is removed from the dyeing solution and allowed to dry, usually at ambient temperatures.

In another aspect of this invention, the water-soluble dyeing composition used to coat at least one face of an insert which is thereafter affixed to an inside surface of a preformed shaped container is made by admixing about 50–75 parts by weight of water, usually ordinary tap water, about 10–20 parts by weight of polyvinyl alcohol as the water-soluble dye carrier, and about 4–20 parts by weight of food grade dye or mixtures of dyes and about 2 to 5 parts by weight of glycerin as the water-soluble dye carrier plasticizer. Usually about 0.5 parts of an organic defoamer is admixed with the polyvinyl alcohol and about 0.1 to 0.6 percent of preservatives are also included. The order of mixing is not critical. In a preferred aspect, the weighed amounts of water and organic defoamer, polyvinyl alcohol are mixed at a temperature in the range of about 75°–85° C. to form a solution and the glycerin and water-soluble dye are successively added thereto with stirring. The solution is normally maintained at a temperature in the range of about 60°–65° C. when the water-soluble dye is added. Normally, the admixing is performed in a large mixing vessel and the dyeing composition at 30° C. are silk screened onto either face of 10 mil-thick sheets of corona-treated polystyrene. The sheets are passed to a drying oven and the water is allowed to evaporate to form a coating of water-soluble dye composition on face of the corona-treated polystyrene sheets. The temperature of the drying step is not critical so long as it is not so high that it decomposes or adversely affects said water-soluble dye composition or the polystyrene. The drying step may be performed by use of any technique, e.g. by heating lyophilization or freeze drying, well known to those skilled in the art to produce a coating on a surface.

By the term "dry" as used herein is meant sufficiently free of water to enable the dyeing composition coated onto the insert material to remain adhered to the insert material, where coated, without streaking or running off. Typically, the water content of the dry water-soluble dyeing composition coated on the insert material is in the range of less than about 2 weight percent.

However, the amount of water present in the dry water-soluble dye composition coated on the insert of the shaped container is not critical and may be any amount but usually less than about 2% by weight (even as high as about 20 weight percent when polyethylene glycol is the water soluble dye carrier) so long as the water-soluble dye composition is present as a solid or even semi-solid mass which adheres to the insert material of the shaped container. Of course, the precise amount of water present in the dry water-soluble dyeing composition present as a solid mass coated on the insert affixed to the shaped container will vary as the relative humidity and temperature of air vary.

The preformed shaped container may be of any shape and chemical composition so long as it is compatible with the water-soluble dyeing composition and has a volume (e.g. 250 mL or 8 oz) large enough to hold the egg to be dyed. Normally cups constructed of, for example, glass, styrofoam, polystyrene, polyethylene, polyvinyl chloride polypropylene, paper, plastic (e.g. polyethylene)-coated-paper or aluminum foil may be used.

The water-soluble dyes used are the water-soluble FDA-approved dyes conventionally used to color Easter eggs or to decorate eggs. In addition, this invention enables some water-soluble dyes, e.g., F.D.&C. Red #40 to be used where before this color was unsatisfactory for dyeing eggs. Some of the conventional colors used are a combination of, for example F.D.&C. Red #40, F.D.&C. Yellow #5 and F.D.&C. Blue #2 to achieve a brown color; F.D.&C. Yellow #6 to achieve an orange color; approximately equal amounts of F.D.&C. Yellow #5 and F.D.&C. Blue #1 to achieve a green color; F.D.&C. Red #3 for a pink color, and F.D.&C. Yellow #5 with a minor amount of F.D.&C. Blue #1 to achieve a chartreuse color. Other colors and combinations of colors known to the art are also suitable. The specific colors used are not critical to this invention. The amount of water-soluble dye used in the methods and compositions of the present invention depend on the particular dye or mixture of dyes and the color desired. Generally, the amounts vary from about 10 to about 30 weight percent of the water-soluble dyeing composition.

Various modifications such as the pretreatment step of U.S.Pat. No. 4,664,925 and others well known to those skilled in the art may be made without deviating from the scope of the present invention.

In the preferred embodiment of this invention, the water-soluble dyeing composition of the present invention is applied unto either the rough or smooth face, preferable the smooth face of a flat 10 mil thick sheet of corona-treated polystyrene. Application of the water-soluble dyeing composition may be accomplished by any means such as for example pad printing, silk screening or spraying. The coated sheets are passed via conveyor onto a dry oven at 65° to 99° C. or are allowed to dry preferably at ambient temperatures before said coated sheets are cut unto inserts of a shape compatible with the shaped containers.

The sheets of insert materials coated with the dry water-soluble dyeing composition are conveniently die cut into the desired shape compatible with the shape of the container by means of a dye stamping apparatus. When non-corona-treated polystyrene is used the inserts are placed, coating side down into the shaped containers. Conveniently holes are punched into the disks having the coating side down to allow complete quick mixing. In a preferred embodiment of the present invention, partially flat bottomed, hemioval-shaped containers having an oval-shaped insert cut out from the dry water-soluble dye composition coated sheet are used. Thus, accidental spilling of the water-soluble dyeing compositions during egg dyeing using such flat-bottomed hemioval shaped containers is unlikely.

When the insert material used is paper (labelling stock), the dyeing composition is applied thereto by silk-screening methods and the water is conveniently removed by lyophilization or freeze drying.

Reference is made to FIG. 1 which illustrates a preferred embodiment of a partially flat bottomed hemioval shaped container A of the present invention having top opening 10, side walls 12 extending from the opening 10 to the closed and bottom 14. An insert 16 coated with the dry water-soluble dyeing composition of this invention is secured into an annular protrusion 18 in walls 12 intermediate to top opening 10 and the bottom 14, but essentially adjacent to the bottom 14. Other securing means equivalent to the annular protrusion 18 and well known to those skilled in the art such as lugs (not shown) can also be used.

Figure 2:
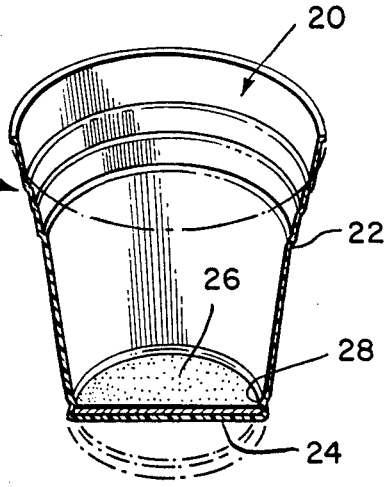
FIG. 2 is a side elevational view of another preferred embodiment of the present invention showing a flat bottomed cylindrical-shaped container having a circular insert coated with a dry water-soluble dyeing composition.

FIG. 2 illustrates another preferred embodiment of a flat-bottomed cylindrical-shaped container B of the present invention having a circular insert 26 coated with the dry water-soluble dyeing composition of this invention. The insert 26 is secured by an annular protrusion 28 in side walls 22 which extend from the top opening 20 of the near bottom 24.

Figure 3:
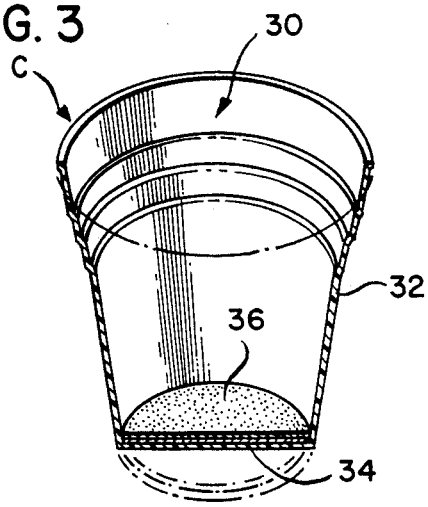
FIG. 3 is a side elevational view of another preferred embodiment of the present invention showing a flat-bottomed cylindrical shaped container having a circular disk affixed to the bottom.

FIG. 3 illustrates another preferred embodiment of a flat-bottomed cylindrical-shaped container C of the present invention having an insert 36 affixed to the bottom 34 by means of waterproof adhesive compositions well known to those skilled in the art.

Figure 4:
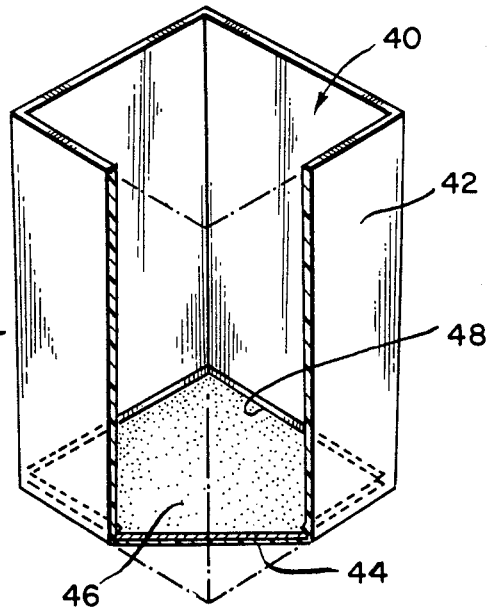
FIG. 4 is a side elevational view of another preferred embodiment of the present invention showing a cube-shaped container having a square insert coated with a dry water-soluble dyeing composition.

FIG. 4 illustrates another preferred embodiment of a flat-bottomed cube-shaped container D of the present invention having a coated square insert 46 secured into the annular protrusion 48 positioned near bottom 44.

The following examples illustrate the invention. In each example chicken eggs purchased at a local grocery store are used.

EXAMPLES 1–6

Procedure

Admix the water, organic defoamer and polyvinyl alcohol of Part A at 77°–82° C. until a homogeneous mixture is formed. Add the glycerin and preservatives of Part B and admix until a homogeneous mixture is formed. Add the FD&C color of Part C and admix until homogeneous. Cool while admixing the so-formed homogeneous mixture to 60°–63° C. Fill into polyethylene lined pails.

EXAMPLE 1

Yellow Dyeing Composition

| % W/W | Ingredient |
|---|---|
| | Part A |
| 59.83 | Water |
| 16.00 | polyvinyl alcohol |
| 00.60 | Foam Burst 338 organic defoamer |
| | Part B |
| 3.00 | Glycerine USP, 99% |
| 0.45 | Citric acid |
| | sodium benzoate |
| | Part C |
| 20.00 | FD&C Yellow #5 |
| 100.00 | |

EXAMPLE 2

Blue Dyeing Composition

| % W/W | Ingredient |
|---|---|
| | Part A |
| 58.727 | Water |
| 00.600 | Foam Burst 338 |
| 17.000 | Polyvinyl Alcohol |
| | Part B |
| 3.000 | Glycerin USP, 99% |
| 0.550 | Citric Acid |
| 0.123 | Sodium Benzoate |
| | Part C |
| 20.00 | FD&C Blue No. 1 |
| 100.00% | |

EXAMPLE 3

Chartreuse Dyeing Composition

| % W/W | Ingredient |
|---|---|
| | Part A |
| 59.669 | Water |
| 0.660 | Foam Burst 338 organic defoamer |
| 15.000 | polyvinyl alcohol |
| | Part B |
| 3.000 | Glycerin, USP, 99% |
| 0.450 | citric acid, USP |
| 0.121 | sodium benzoate, USP |
| | Part C |
| 1.160 | FD&C Blue #1 |
| 20.000 | FD&C Yellow #5 |
| 100.00% | |

EXAMPLE 4

Orange Dyeing Composition

| % W/W | Ingredient |
|---|---|
| | Part A |
| 63.792 | Water |
| 0.600 | Foam Burst 338 organic defoamer |
| 16.000 | Polyvinyl Alcohol |
| | Part B |
| 3.000 | Glycerin, USP, 99% |
| 0.500 | Citric Acid, USP |
| 0.108 | Sodium Benzoate, USP |
| | Part C |
| 16.000 | FD&C Yellow #6 |
| 100.00% | |

EXAMPLE 5

Green Dyeing Composition

| % W/W | Ingredient |
|---|---|
| | Part A |
| 56.811 | Water |
| 0.600 | Foam Burst 338 organic defoamer |
| 14.000 | Polyvinyl Alcohol |
| | Part B |
| 3.000 | Glycerin, USP, 99% |
| 0.450 | Citric Acid, USP |
| 0.129 | Sodium Benzoate, USP |
| | Part C |
| 13.3400 | FD&C Blue #1 |
| 11.6700 | FD&C Yellow #5 |
| 100.00% | |

EXAMPLE 6

Pink Dyeing Composition

| % W/W | Ingredient |
|---|---|
| | Part A |
| 68.400 | Water |
| 0.500 | Foam Burst 338 organic defoamer |
| 18.000 | Polyvinyl Alcohol |
| 0.100 | Methylparaben NF |
| | Part B |
| 3.000 | Glycerin, USP, 99% |
| | Part C |
| 10.000 | FD&C Red #3 |

-continued

| % W/W | Ingredient |
|---|---|
| 100.00% | |

EXAMPLE 7

Color Cup Egg Dyeing Kit

Fill the dyeing composition of Example 1 into a silk-screen applicator and apply a coating of same onto 10 ml sheets of corona-treated polystyrene. Dry the coated sheets in a drying oven at 90° C. Die cut the dried coated sheets into egg shaped discs. Insert the discs into egg-shaped cups as shown in FIG. 1. The disc are secured in the cup by annular protrusion or undercut molded into sidewalls near bottom of cup. Repeat procedure using dyeing compositions of Examples 2 to 6. Label each of the six cups having the coated discs with the appropriate color and pack them in a single package containing instructions for use as detailed in Example 8.

EXAMPLE 8

Add 2–4 oz (60–120 mL) of water and 1 tablespoon (15 mL) of vinegar to each cup of Example 7. Mix until the dyeing composition coated on disc is dissolved.

Dip a boiled egg into the dye solution in the cup for 3 minutes, remove and allow to dry.

What is claimed is:

1. A package comprising a shaped container of a size suitable for dyeing eggs therein having:

(a) a top opening,
(b) side walls connected to,
(c) a bottom
(d) an insert selected from the group consisting of corona-treated food grade polystyrene and food grade polystyrene, said insert having at least one face coated with a dry water-soluble dyeing composition comprising:
  (i) about 12 to about 20 parts by weight of a water-soluble dye carrier.
  (ii) about 2 to about 5 parts by weight of a water-soluble dye carrier plasticizer for said carrier, and
  (iii) about 10 to about 30 parts by weight of a water-soluble dye or mixtures thereof, and
(e) means for securing said insert in a position at the bottom of said shaped container.

2. A shaped container of claim 1 wherein said means for securing said insert is an annular inward protrusion positioned in said side walls and having a size slightly smaller than the size of said insert and sufficient to hold said insert in the position at the bottom of said shaped container.

3. A shaped container of claim 1 wherein said means for securing said insert is a waterproof adhesive on the inside surface of said bottom of said shaped container.

4. A shaped container of claim 1 wherein the insert is an egg-shaped disk.

5. A shaped container of claim 1 wherein said means for securing said insert is a waterproof adhesive on the inside surface of said bottom of said shaped container or on the non-coated face of said insert.

6. A shaped container of claim 5 wherein said means for securing said insert is a waterproof adhesive on the non-coated face of said insert.

7. A package comprising a shaped container of a size suitable for dyeing eggs therein having:

(a) a top opening,
(b) side walls connected to,
(c) a bottom,
(d) an insert having at least one face coated with a dry water-soluble dyeing composition, and
(e) an annular inward protrusion positioned in said side walls and having a size slightly smaller than the size of said insert and sufficient to hold said insert in the position at the bottom of said shaped container.

8. A shaped container of claim 7 wherein the insert is polystyrene.

9. A shaped container of claim 7 wherein the insert is corona-treated polystyrene.

10. A package comprising a shaped container of a size suitable for dyeing eggs therein having:

(a) a top opening,
(b) side walls connected to,
(c) a bottom,
(d) an insert having at least one face coated with a dry water-soluble dyeing composition comprising:
  (i) about 12 to about 20 parts by weight of a water-soluble dye carrier,
  (ii) about 2 to about 5 parts by weight of a water-soluble dye carrier plasticizer for said carrier, and
  (iii) about 10 to about 30 parts by weight of a water-soluble dye or mixtures thereof, and
(e) an annular inward protrusion positioned in said side walls and having a size slightly smaller than the size of said insert and sufficient to hold said insert in the position a the bottom of said shaped container.

11. A package comprising a shaped container of a size suitable for dyeing eggs therein having:

(a) a top opening,
(b) side walls connected to,
(c) a bottom,
(d) an insert having at least one face coated with a dry water-soluble dyeing composition comprising:
  (i) about 12 to about 20 parts by weight of a water-soluble dye carrier,
  (ii) about 2 to about 5 parts by weight of a water-soluble dye carrier plasticizer for said carrier, and
  (iii) about 10 to about 30 parts by weight of a water-soluble dye or mixtures thereof, and
(e) means for securing said insert in a position at the bottom of said shaped container.

* * * * *